US006216502B1

(12) United States Patent
Cannella et al.

(10) Patent No.: US 6,216,502 B1
(45) Date of Patent: Apr. 17, 2001

(54) KEYLESS LOCKING SYSTEM

(76) Inventors: Thomas Cannella, 1416 View Top Dr., Clearwater, FL (US) 33764; Robert Cannella, 8023 Cardinal Dr., Tampa, FL (US) 33617

( * ) Notice: Subject to any disclaimer, the term of this patent is extended or adjusted under 35 U.S.C. 154(b) by 0 days.

(21) Appl. No.: 09/542,298

(22) Filed: Apr. 4, 2000

(51) Int. Cl.[7] ..... E05B 47/02

(52) U.S. Cl. ..... 70/277; 70/257; 70/280; 292/142; 292/144

(58) Field of Search ..... 70/257, 278.1, 70/278.3, 279.1, 277, 280–282; 292/142, 144

(56) References Cited

U.S. PATENT DOCUMENTS

| | | | | |
|---|---|---|---|---|
| 4,438,962 | * | 3/1984 | Soloviff et al. | 292/144 |
| 4,557,124 | * | 12/1985 | Russ | 70/456 R |
| 5,095,654 | * | 3/1992 | Eccleston | 292/144 X |
| 5,531,086 | * | 7/1996 | Bryant | 70/279.1 |
| 5,678,436 | * | 10/1997 | Alexander | 70/278.3 |
| 5,790,034 | * | 8/1998 | Khoury | 292/144 X |
| 5,857,365 | * | 1/1999 | Armstrong | 292/144 X |
| 5,979,199 | * | 11/1999 | Elpern et al. | 70/279.1 |
| 6,012,310 | * | 1/2000 | Hsiao | 292/144 X |
| 6,062,612 | * | 5/2000 | Lin | 292/144 |
| 6,076,383 | * | 6/2000 | Clark et al. | 70/189 |

FOREIGN PATENT DOCUMENTS

WO 91/00405 * 1/1991 (WO) ..... 70/279.1

* cited by examiner

*Primary Examiner*—Lloyd A. Gall

(57) ABSTRACT

A keyless locking system includes a housing in a generally rectilinear configuration having a plate with peripheral edge walls to form an open housing there between. A rotatable assembly is secured to the front wall and includes a visible rotator extending inwardly from the front wall and a cylindrical shaft extending through the front wall. A C-shaped channel member extending interiorly from the front wall to encompass and contact the sides of the deadbolt. A gearing assembly includes a large gear coupled to the channel member and a smaller gear and an intermediate gear whereby rotation of the intermediate gear will rotate the smaller gear and then the larger gear to rotate the channel member and deadbolt to lock and unlock the door. A motor within the housing with an associated battery drives the intermediate gear. An electronic assembly effects the driving of the motor and intermediate gear in a first direction and then a second direction. A control member, adapted to be held by the hand of the user, includes an actuator adapted to be moved to drive the motor a predetermined number of revolutions to rotate the intermediate gear, small gear, large gear, channel member and deadbolt for either locking or unlocking the door. An adhesive is secured to the housing interiorly of the edge walls to secure the housing onto a door with the channel member over the deadbolt of the door.

4 Claims, 3 Drawing Sheets

FIG 5
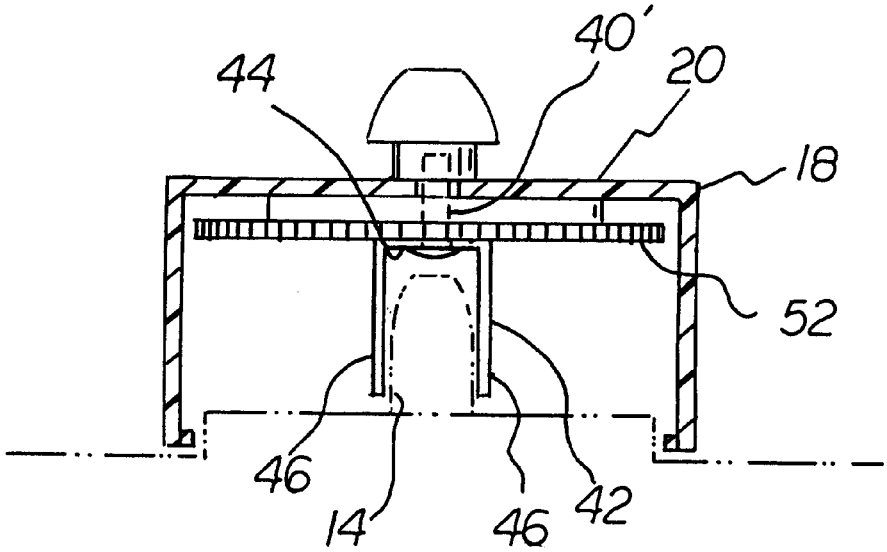
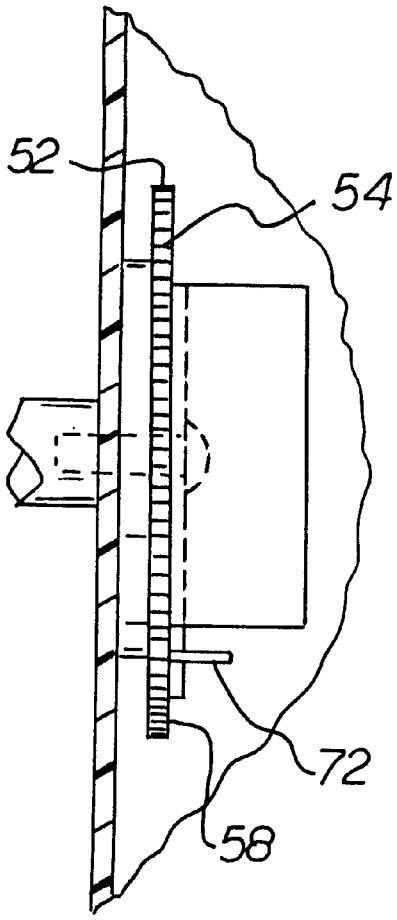
FIG 6

KEYLESS LOCKING SYSTEM

BACKGROUND OF THE INVENTION

1. Field of the Invention

The present invention relates to a keyless locking system and more particularly pertains to conveniently locking and unlocking a deadbolt for a door from a remote location without modifying the existing deadbolt.

2. Description of the Prior Art

The use of door locking systems of known designs and configurations is known in the prior art. More specifically, door locking systems of known designs and configurations previously devised and utilized for the purpose of locking and unlocking deadbolts through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,829,138 to Morita discloses a remotely controlled latch system for fire doors and the like. U.S. Pat. No. 4,593,543 to Stefanek discloses a security lock. U.S. Pat. No. 5,896,769 to Elpern et al. discloses a electrically operated actuator. U.S. Pat. No. 5,979,199 to Elpern et al. discloses an electrically operated actuator. Lastly, U.S. Pat. No. 5,987,818 to Dabideen discloses a remotely controlled door locking and opening system.

While these devices fulfill their respective, particular objectives and requirements, the aforementioned patents do not describe a keyless locking system that allows conveniently locking and unlocking a deadbolt for a door from a remote location without modifying the existing deadbolt.

In this respect, the keyless locking system according to the present invention substantially departs from the conventional concepts and designs of the prior art, and in doing so provides an apparatus primarily developed for the purpose of conveniently locking and unlocking a deadbolt for a door from a remote location without modifying the existing deadbolt.

Therefore, it can be appreciated that there exists a continuing need for a new and improved keyless locking system which can be used for conveniently locking and unlocking a deadbolt for a door from a remote location without modifying the existing deadbolt. In this regard, the present invention substantially fulfills this need.

SUMMARY OF THE INVENTION

In view of the foregoing disadvantages inherent in the known types of door locking systems of known designs and configurations now present in the prior art, the present invention provides an improved keyless locking system. As such, the general purpose of the present invention, which will be described subsequently in greater detail, is to provide a new and improved keyless locking system and method which has all the advantages of the prior art and none of the disadvantages.

To attain this, the present invention essentially comprises a keyless locking system for conveniently locking and unlocking a deadbolt of a door. First provided is a housing. The housing is formed in a generally rectilinear configuration. The housing has a planar plate constituting a front wall. The planar plate has an upper edge and a lower edge. The planar plate also has parallel side edges between the upper and lower edges. The planar plate also has peripheral edge walls extending inwardly from the upper edge, lower edge and side edges to form an open housing between the edges. Next provided is a rotatable assembly. The rotatable assembly is secured to the front wall adjacent to the lower edge. The rotatable assembly includes a visible rotator extending inwardly from the front wall. The rotator is adapted to be manually turned or turned from a remote location. The assembly has a cylindrical shaft extending through the front wall. The assembly also has a C-shaped channel member extending interiorly from the rotator. The channel member includes a vertical plate positionable external of the deadbolt to be turned. The channel member also has inwardly extending sidewalls to encompass and contact the sides of the deadbolt to cause the turning of the deadbolt. The channel member is adapted to be rotated upon the rotation of the shaft. Next provided is a gearing assembly. The gearing assembly includes a large gear. The large gear has peripheral teeth coaxially coupled to the channel member and the shaft for rotation. The gearing assembly also has a smaller gear. The smaller gear has peripheral teeth in mating contact with the teeth of the larger gear for mutual rotation between the larger and smaller gears. The gearing assembly also includes a worm gear. The worm gear has spiral teeth in contact with the smaller gear whereby rotation of the worm gear about an axis perpendicular to the axis of the large gear and small gear will rotate the smaller gear and then the larger gear to rotate the channel member and deadbolt to lock and unlock the door. Next provided is a motor. The motor is located within the housing. Also provided is a battery associated with the motor to drive the worm gear. Next provided is an electronic assembly. The electronic assembly functions to effect the driving of the motor and worm gear in a first direction and then a second direction. The electronic assembly includes an associated switch under the control of an operator for initiating the driving of the electronic assembly and motor in either one direction or the other as a function of the nature of the deadbolt to be turned. Next provided is a control member. The control member is adapted to be held by the hand of the user. The control member includes a button adapted to be pressed to drive the motor a predetermined number of revolutions to rotate the worm gear, small gear, large gear, channel member and deadbolt for either locking or unlocking the door. Lastly provided is an adhesive. The adhesive is secured to the housing interiorly of the edge walls to secure the housing onto a door with the channel member over the deadbolt of the door.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved keyless locking system which has all of the advantages of the prior art door locking systems of known designs and configurations and none of the disadvantages.

It is another object of the present invention to provide a new and improved keyless locking system which may be easily and efficiently manufactured and marketed.

It is a further object of the present invention to provide a new and improved keyless locking system which is of durable and reliable constructions.

An even further object of the present invention is to provide a new and improved keyless locking system which is susceptible of a low cost of manufacture with regard to both materials and labor, and which accordingly is then susceptible of low prices of sale to the consuming public, thereby making such keyless locking system economically available to the buying public.

Even still another object of the present invention is to provide a keyless locking system for conveniently locking and unlocking a deadbolt for a door from a remote location without modifying the existing deadbolt.

Lastly, it is an object of the present invention to provide a new and improved keyless locking system including a housing in a generally rectilinear configuration having a plate with peripheral edge walls to form an open housing there between. A rotatable assembly is secured to the front wall and includes a visible rotator extending inwardly from the front wall and a cylindrical shaft extending through the front wall. A C-shaped channel member extending interiorly from the front wall to encompass and contact the sides of the deadbolt. A gearing assembly includes a large gear coupled to the channel member and a smaller gear and an intermediate gear whereby rotation of the intermediate gear will rotate the smaller gear and then the larger gear to rotate the channel member and deadbolt to lock and unlock the door. A motor within the housing with an associated battery drives the intermediate gear. An electronic assembly effects the driving of the motor and intermediate gear in a first direction and then a second direction. A control member, adapted to be held by the hand of the user, includes an actuator adapted to be moved to drive the motor a predetermined number of revolutions to rotate the intermediate gear, small gear, large gear, channel member and deadbolt for either locking or unlocking the door. An adhesive is secured to the housing interiorly of the edge walls to secure the housing onto a door with the channel member over the deadbolt of the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 4.

FIG. 6 is a cross sectional view taken along line 6—6 of FIG. 4.

The same reference numerals refer to the same parts throughout the various Figures.

DESCRIPTION OF THE PREFERRED EMBODIMENT

Figure 1:
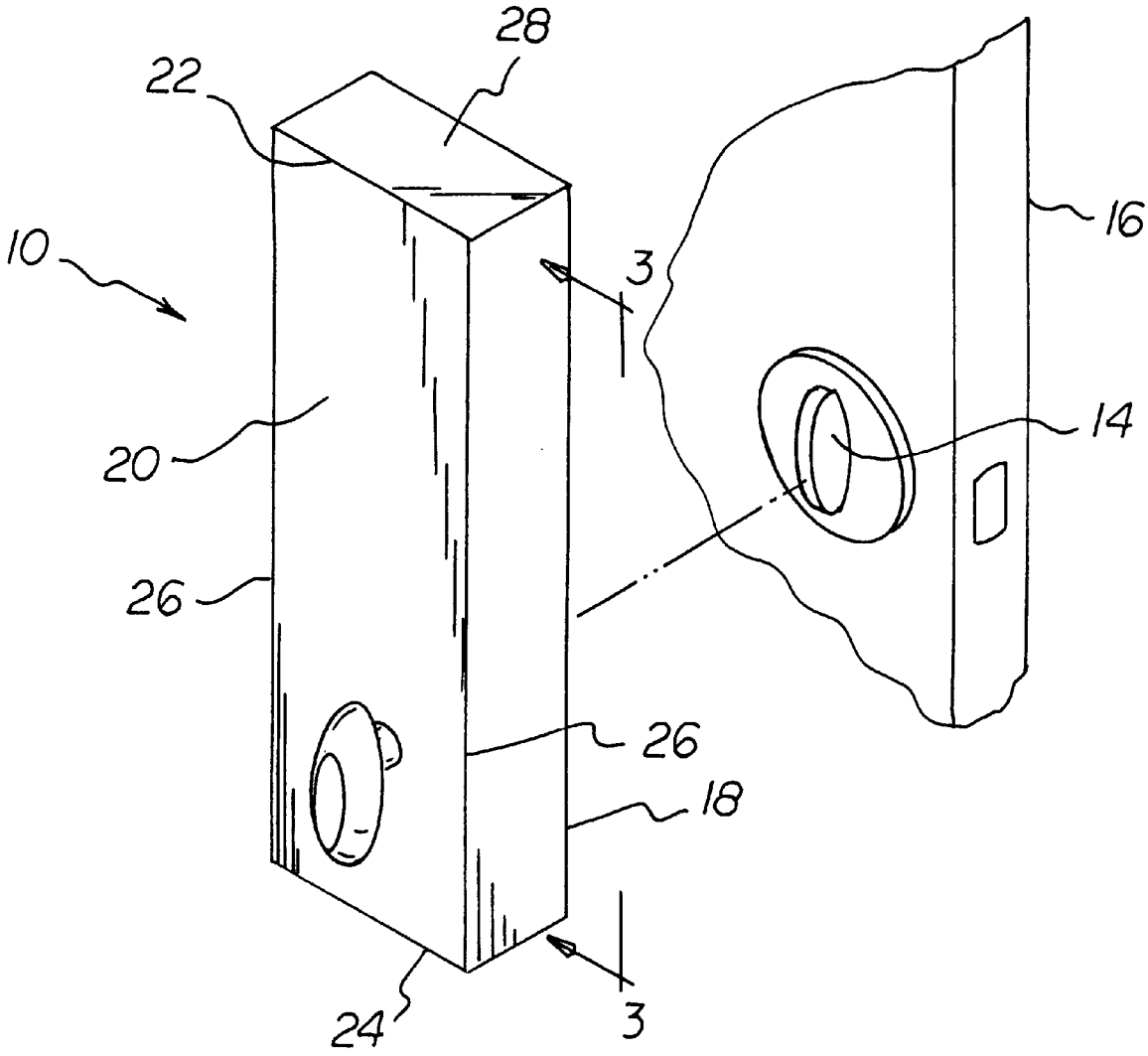
FIG. 1 is a perspective illustration of the new and improved keyless locking system constructed in accordance with the principles of the present invention.
Figure 2:
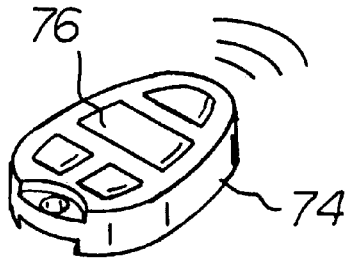
FIG. 2 is a perspective view of the remote control member to effect the operation of the apparatus shown in FIG. 1.
Figure 3:
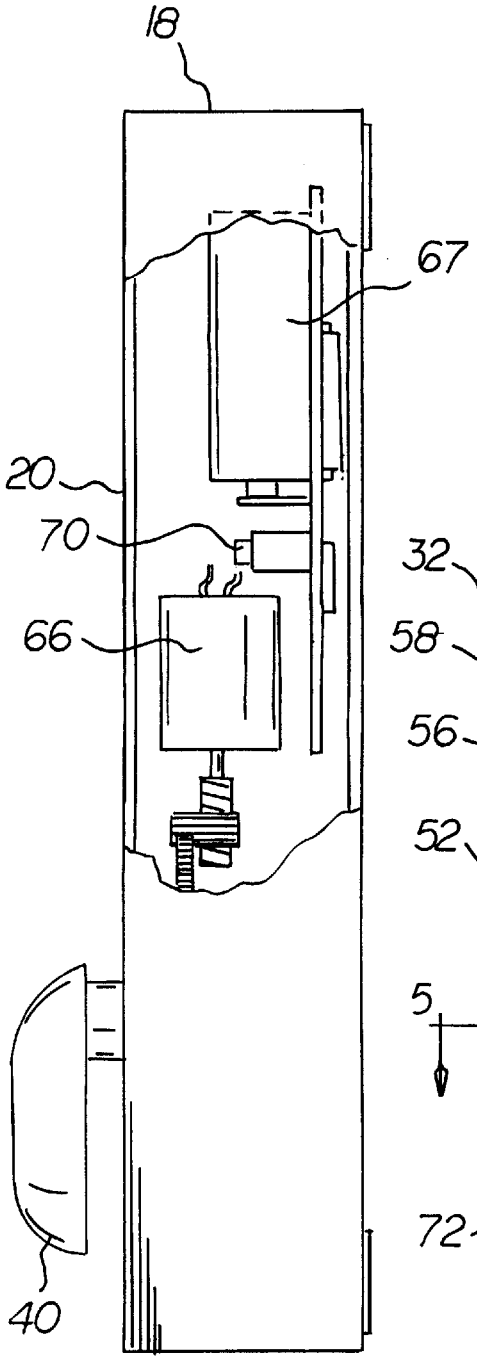
FIG. 3 is a side elevational view taken along line 3—3 of FIG. 1 with parts removed to show certain internal constructions thereof.
Figure 4:
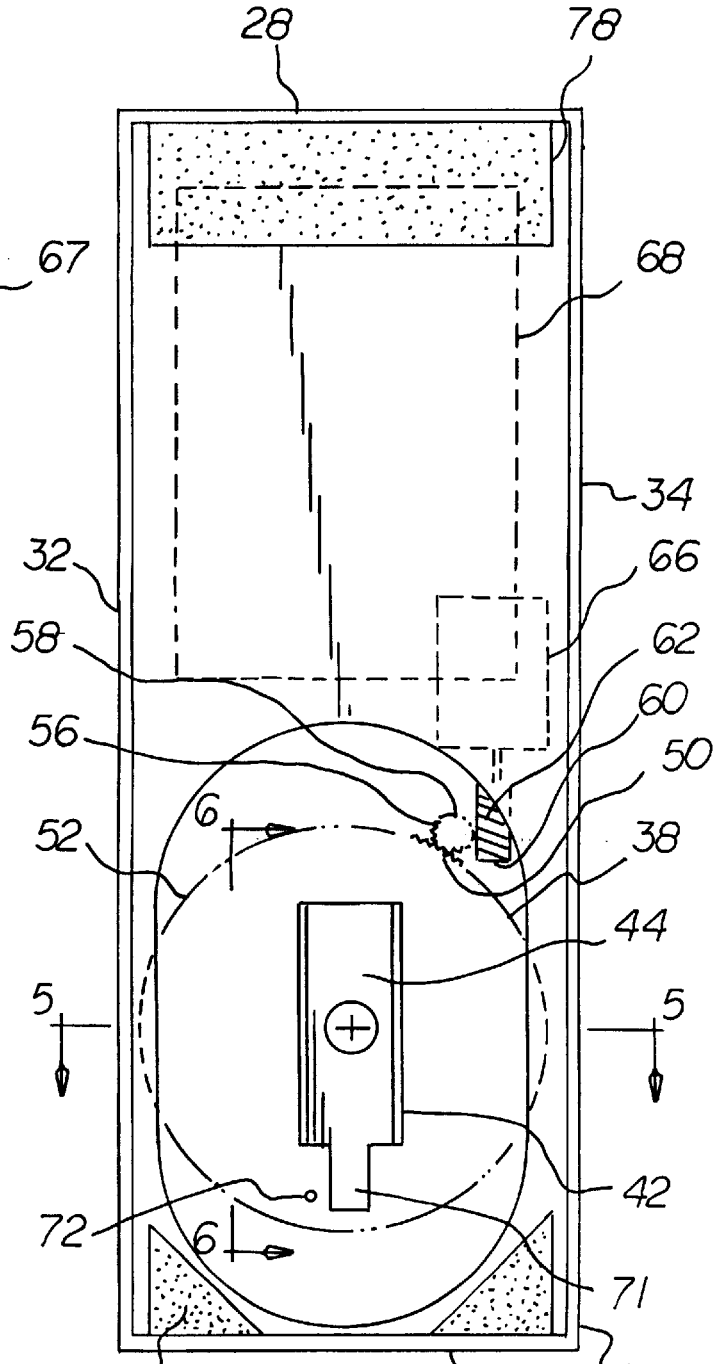
FIG. 4 is a rear elevational view of the apparatus shown in FIGS. 1 and 3.

With reference now to the drawings, and in particular to FIG. 1 thereof, the preferred embodiment of the new and improved keyless locking system embodying the principles and concepts of the present invention and generally designated by the reference numeral 10 will be described.

The present invention, the keyless locking system 10 for conveniently locking and unlocking a deadbolt 14 of a door 16 is comprised of a plurality of components. Such components in their broadest context include a housing, a rotatable assembly, a large gear assembly, a motor, an electronic assembly, a battery, and a control member. Such components are individually configured and correlated with respect to each other so as to attain the desired objective.

First provided is a housing 18. The housing is formed in a generally rectilinear configuration. The housing has a planar plate 20 constituting a front wall. The planar plate has an upper edge 22 and a lower edge 24. The planar plate also has parallel side edges 26 between the upper and lower edges. The planar plate also has peripheral edge walls 28, 30, 32, 34 extending inwardly from the upper edge, lower edge and side edges to form an open housing between the edges.

Next provided is a rotatable assembly 38. The rotatable assembly is secured to the front wall adjacent to the lower edge. The rotatable assembly includes a visible rotator 40 extending inwardly from the front wall. The rotator is adapted to be manually turned or turned from a remote location. The assembly has a cylindrical shaft 40' extending through the front wall. The assembly also has a C-shaped channel member 42 extending interiorly from the rotator. The channel member includes a vertical plate 44 positionable external of the deadbolt to be turned. The channel member also has inwardly extending sidewalls 46 to encompass and contact the sides of the deadbolt to cause the turning of the deadbolt. The channel member is adapted to be rotated upon the rotation of the shaft.

Next provided is a gearing assembly 50. The gearing assembly includes a large gear 52. The large gear has peripheral teeth 54 coaxially coupled to the channel member and the shaft for rotation. The gearing assembly also has a smaller gear 56. The smaller gear has peripheral teeth 58 in mating contact with the teeth of the larger gear for mutual rotation between the larger and smaller gears. The gearing assembly also includes a worm gear 60. The worm gear has spiral teeth 62 in contact with the smaller gear whereby rotation of the worm gear will rotate the smaller gear and then the larger gear to rotate the channel member and deadbolt to lock and unlock the door.

Next provided is a motor 66. The motor is located within the housing. Also provided is a battery 67 associated with the motor to drive the worm gear.

Next provided is an electronic assembly 68. The electronic assembly functions to effect the driving of the motor and worm gear in a first direction and then a second direction. The electronic assembly includes an associated switch 70 under the control of an operator for initiating the driving of the electronic assembly and motor in either one direction or the other as a function of the nature of the deadbolt to be turned.

A downwardly extending extension 71 on the vertical plate 44 is adapted to contact and rotate a pin 72 on the large gear 52. This relationship allows the motor to move the large gear and pin prior to contacting the extension and rotation of the dead bolt. This allows contacting the extension and rotation of the dead bolt. This allows the motor to build up torque prior to rotating the dead bolt. Other techniques may be utilized for building up the powering torque as is desired for maximum efficiency.

Next provided is a control member 74. The control member is adapted to be held by the hand of the user. The control member includes an actuator, preferably a button 76 adapted to be pressed or otherwise moved to drive the motor a predetermined number of revolutions to rotate the worm gear, small gear, large gear, channel member and deadbolt for either locking or unlocking the door.

Lastly provided is an adhesive 78. The adhesive is secured to the housing interiorly of the edge walls, or at least a portion thereof, to secure the housing onto a door with the channel member over the deadbolt of the door.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved keyless locking system for conveniently locking and unlocking a deadbolt of a door from a remote location without modifying the existing deadbolt comprising, in combination:

a housing in a generally rectilinear configuration having a planar plate constituting a front wall with an upper edge, a lower edge, and parallel side edges therebetween and with peripheral edge walls extending inwardly from the upper edge, lower edge and side edges to form an open housing therebetween;

a rotatable assembly rotatably secured to the front wall adjacent to the lower edge, the rotatable assembly including a visible rotator adapted to be manually turned or turned from a remote location and with a cylindrical shaft extending through the front wall and with a C-shaped channel member extending interiorly therefrom, the channel member including a vertical plate positionable external of the deadbolt to be turned and with inwardly extending sidewalls to encompass and contact the sides of the deadbolt to cause the turning thereof, the channel member adapted to be rotated upon the rotation of the shaft;

a gearing assembly including a large gear having peripheral teeth coaxially coupled to the channel member and the shaft for rotation and with a smaller gear having peripheral teeth in mating contact with the teeth of the large gear for mutual rotation therebetween and with a worm gear having spiral teeth in contact with the smaller gear whereby rotation of the worm gear will rotate the smaller gear and then the large gear to rotate the channel member and deadbolt to lock and unlock the door;

a motor within the housing with an associated battery to drive the worm gear;

an electronic assembly to effect the driving of the motor and worm gear in a first direction and then a second direction with an associated switch under the control of an operator for initiating the driving of the electronic assembly and motor in either one direction or the other as a function of the nature of the deadbolt to be turned;

a control member adapted to be held by the hand of the user, the control member including a button adapted to be pressed to drive the motor a predetermined number of revolutions to rotate the worm gear, smaller gear, large gear, and channel member for either locking or unlocking the door; and an adhesive secured to the housing interiorly of the edge walls to secure the housing onto a door with the channel member over the deadbolt of the door.

2. A keyless locking system comprising:

a housing in a generally rectilinear configuration having a front wall with peripheral edge walls to form an open housing therebetween;

a rotatable assembly secured to the front wall including a visible rotator and with a cylindrical shaft extending through the front wall and with a C-shaped channel member extending interiorly therefrom to encompass and contact the sides of a deadbolt;

a gearing assembly including a large gear coupled to the channel member and with a smaller gear and with an intermediate gear whereby rotation of the intermediate gear will rotate the smaller gear and then the large gear to rotate the channel member and deadbolt to lock and unlock a door;

a motor within the housing with an associated battery to drive the intermediate gear;

an electronic assembly to effect the driving of the motor and intermediate gear in a first direction and then a second direction;

a control member adapted to be held by the hand of the user, the control member including an actuator adapted to be moved to drive the motor a predetermined number of revolutions to rotate the intermediate gear, smaller gear, large gear, and channel member for either locking or unlocking the door; and an adhesive secured to the housing interiorly of the edge walls to secure the housing onto a door with the channel member over the deadbolt of the door.

3. The system as set forth in claim 2, the electronic assembly further including an associated switch under the control of an operator for initiating the driving of the electronic assembly and the motor in either one direction or the other as a function of the nature of the deadbolt to be turned.

4. A keyless locking method comprising:

providing a housing in a generally rectilinear configuration having a plate with peripheral edge walls to form an open housing therebetween;

providing a rotatable assembly secured to a front wall including a visible rotator and with a cylindrical shaft extending through the front wall and with a C-shaped channel member extending interiorly therefrom to encompass and contact the sides of a deadbolt;

providing a gearing assembly including a large gear coupled to the channel member and with a smaller gear and with an intermediate gear whereby rotation of the intermediate gear will rotate the smaller gear and then the large gear to rotate the channel member and deadbolt to lock and unlock a door;

providing a motor within the housing with an associated battery to drive the intermediate gear;

providing an electronic assembly to effect the driving of the motor and intermediate gear in a first direction and then a second direction;

providing an adhesive secured to the housing interiorly of the edge walls to secure the housing onto a door with the channel member over the deadbolt of the door; and activating a control member adapted to be held by the hand of the user, the control member including an actuator adapted to be moved to drive the motor a predetermined number of revolutions to rotate the intermediate gear, smaller gear, large gear, and channel member for either locking or unlocking the door.

* * * * *